US007486240B2

(12) United States Patent
Chintala

(10) Patent No.: US 7,486,240 B2
(45) Date of Patent: Feb. 3, 2009

(54) DEVICES AND METHODS FOR RETAINING AN ANTENNA

(75) Inventor: Thomas J. Chintala, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 445 days.

(21) Appl. No.: 10/964,403

(22) Filed: Oct. 12, 2004

(65) Prior Publication Data

US 2006/0079188 A1 Apr. 13, 2006

(51) Int. Cl.
*H01Q 1/24* (2006.01)

(52) U.S. Cl. ..... 343/702; 343/906

(58) Field of Classification Search ..... 343/702, 343/906, 900, 715, 713
See application file for complete search history.

(56) References Cited

U.S. PATENT DOCUMENTS 3,568,200 A * 3/1971 Seyler ..... 343/702
4,420,706 A 12/1983 Siebold et al.
4,912,602 A 3/1990 Zurek et al.
5,213,513 A 5/1993 Brown et al.
5,343,213 A * 8/1994 Kottke et al. ..... 343/702
5,535,437 A 7/1996 Karl et al.
5,658,165 A 8/1997 Yokota
5,691,878 A 11/1997 Ahn et al.
5,721,452 A 2/1998 Fogal et al.
5,830,007 A 11/1998 Fry et al.
5,943,214 A 8/1999 Sato et al.
5,945,952 A * 8/1999 Davidson ..... 343/702
5,959,845 A 9/1999 Faucher
5,984,697 A 11/1999 Moran et al.
6,017,225 A 1/2000 Michiya et al.

(Continued)

FOREIGN PATENT DOCUMENTS

EP 1146588 10/2001
JP 2002141719 * 5/2002

OTHER PUBLICATIONS

International Search Report for International Application No. PCT/US2005/037076, mailed Mar. 30, 2006, International Searching Authority: European Patent Office.

*Primary Examiner*—HoangAnh T Le
(74) *Attorney, Agent, or Firm*—Abdollah Katbab; Nicholas A. Cole; Thomas R. Rouse

(57) ABSTRACT

The disclosed embodiments provide devices and methods for securely retaining an antenna to a communications device. The disclosed embodiments include an antenna assembly connectable with a housing. The antenna assembly may include a connector having a connector body extending from a first end to a second end and thereby defining a longitudinal axis. The first end and the housing include at least one set of corresponding, irreversible engagement members movable one way from an unlocked position and a locked position. In the unlocked position the antenna assembly is movable along the longitudinal axis relative to the communications device, while in the locked position the antenna assembly is not movable along the longitudinal axis relative to the communications device. An antenna is securable relative to the connector body and is connectable with the communications device through an electrical conductor. A retainer mechanism having a retainer body may be fixedly positioned relative to the first engagement member to secure the antenna assembly in the locked position. Methods of retaining an antenna assembly in a communications device are also disclosed.

34 Claims, 4 Drawing Sheets

U.S. PATENT DOCUMENTS

| | | | | |
|---|---|---|---|---|
| 6,111,760 | A | 8/2000 | Nixon | |
| 6,201,503 | B1 * | 3/2001 | Oshiyama | 343/702 |
| 6,215,446 | B1 * | 4/2001 | Sullivan et al. | 343/702 |
| 6,268,836 | B1 * | 7/2001 | Faulkner et al. | 343/895 |
| 6,356,448 | B1 | 3/2002 | DiBene, II et al. | |
| 6,478,597 | B1 | 11/2002 | Roberts et al. | |
| 6,518,928 | B1 * | 2/2003 | Sheu | 343/702 |
| 6,587,351 | B2 | 7/2003 | Hollinsworth et al. | |
| 6,639,561 | B2 * | 10/2003 | Pruss et al. | 343/702 |
| 6,745,058 | B2 * | 6/2004 | Boulay et al. | 455/575.7 |
| 6,757,155 | B2 | 6/2004 | Koike et al. | |
| 6,881,083 | B2 | 4/2005 | Vargas et al. | |
| 6,894,891 | B2 | 5/2005 | Darr et al. | |
| 7,046,206 | B2 * | 5/2006 | Minoura et al. | 343/702 |
| 7,077,692 | B2 | 7/2006 | Chintala | |
| 7,095,375 | B2 * | 8/2006 | Kfoury et al. | 343/702 |
| 7,133,222 | B2 | 11/2006 | Chintala et al. | |
| 7,210,963 | B2 | 5/2007 | Chintala et al. | |
| 2002/0101380 | A1 * | 8/2002 | Pruss et al. | 343/702 |
| 2002/0126053 | A1 * | 9/2002 | Sakaguchi et al. | 343/702 |
| 2002/0131782 | A1 | 9/2002 | Yamaguchi et al. | |
| 2004/0227676 | A1 * | 11/2004 | Kim et al. | 343/702 |
| 2006/0079188 | A1 | 4/2006 | Chintala | |

* cited by examiner

DEVICES AND METHODS FOR RETAINING AN ANTENNA

STATEMENT REGARDING FEDERALLY SPONSORED RESEARCH OR DEVELOPMENT

The disclosed embodiments were made with government support under United States government contract MDA904-01-G-0620 awarded by the National Security Agency. The government may have certain rights in these disclosed embodiments.

CROSS-REFERENCE TO RELATED APPLICATIONS

This invention is related to applicant's following U.S. Patent applications, each hereby incorporated by reference: application Ser. No. 10/963,962, entitled "Devices And Methods For Retaining a Lens In A Mobile Electronic Device, " filed concurrently herewith; application Ser. No. 10/964,105, entitled "Devices And Methods For Creating An Electrical Connection, " filed concurrently herewith; and application Ser. No. 10/964,405, entitled "Devices And Methods For Connecting Housings, "filed concurrently herewith.

BACKGROUND

The disclosed embodiments relate to wireless devices, and more particularly, to devices and methods for retaining an antenna in a wireless communications device.

Wireless communications devices, such as mobile phones, pagers, handheld computers, etc., are becoming increasingly popular for both business and personal use. One advantage of such devices is their "wireless" aspect, allowing them to be utilized whenever and wherever a user desires. In order for such devices to communicate, they must send and receive communications signals via an antenna. It is desirable to have the antenna protrude out from the device to enable it to easily send and receive these communications signals. As such, typical wireless communications devices include a noticeable antenna assembly sticking out from the main housing of the device. Because of their prominence, such antenna assemblies are subject to dislodging forces, either resulting from the impact of a drop or from tampering or wiggling by a user.

Typical antenna designs are not robust enough to handle these dislodging forces, as typical antenna assemblies are designed to allow their removal. For instance, manufacturers typically design an antenna assembly to be easily removed so that it can be serviced or replaced. Further, manufacturers favor a removable antenna assembly design to allow the antenna assembly to be reworked to correct for a mistake or to integrate new parts. For example, in the manufacturing assembly process, when a mistake is made in assembling the wireless communications device or the antenna assembly, manufacturing personnel desire an antenna assembly design that allows such a mistake to be corrected at a point in time after the assembly has been completed. As such, typical antenna assemblies are removable from the housing of the wireless communications device even after they are installed. As discussed above, however, this removable aspect weakens the integrity of the connection between the antenna assembly and the communications device, thereby allowing dislodging forces to remove or damage the antenna assembly, making the wireless communications device useless.

Thus, wireless communications devices and antenna assemblies are desired which provide for a securely retained antenna that is able to withstand all different types of dislodging forces.

BRIEF SUMMARY

In accordance with one aspect, the disclosed embodiments provide a system and method for retaining an antenna in a portable electronic device.

In one embodiment, an electronic device comprises a housing having a first mounting surface and a first engagement member, a communications interface connectable with electronic circuitry and positionable within the housing on the first mounting surface, and an antenna assembly for establishing a connection with a wireless communications media, the antenna assembly comprising an antenna mechanism connectable with the communications interface and a connector body irreversibly connectable to the first engagement member.

In another embodiment, a wireless communications device comprises a housing having a first engagement member, a communications module securable within the housing and having an antenna interface, and an antenna assembly. The antenna assembly comprises a connector body longitudinally extending from a first end to a second end, the first end having a second engagement member connectable with the first engagement member thereby defining a one-way securing mechanism that locks the connector body to the housing. The antenna assembly further includes an antenna element securable relative to the connector body and an electrical conductor having a first contact end and a second contact end, where the first contact end is connectable with the antenna element and the second contact end is connectable with the antenna interface.

In yet another embodiment, an antenna assembly for use with a communications device comprises a connector having a connector body extending from a first end to a second end and thereby defining a longitudinal axis. The first end having a first engagement member movable only once from an unlocked position to a locked position, wherein in the unlocked position the antenna assembly is movable along the longitudinal axis relative to the communications device and in the locked position the antenna assembly is not movable along the longitudinal axis relative to the communications device. The antenna assembly further includes an antenna element securable relative to the connector body and an electrical conductor having a conductor body with a first contact end and a second contact end, the first contact end connectable with the antenna element. The antenna assembly further includes a retainer mechanism having a retainer body fixedly positionable relative to the first engagement member to secure the antenna assembly in the locked position In still another embodiment, method of attaching an antenna to a communications device comprises providing a housing for the communications device, where the housing includes a first mounting surface and a first engagement member. The method further includes providing an antenna assembly for establishing a connection with a wireless communications media, where the antenna assembly comprises an antenna element for sending or receiving communications signals and a connector body. The connector body includes a second engagement member having a first contact position in which a first contact surface is translatable relative to the first engagement member and a second contact position in which a second contact surface is non-translatable relative to the first engagement member. And, the method further includes connecting the second engagement member to the first engagement member such that the second engagement member is in the second contact position.

Additional aspects and advantages of the disclosed embodiments are set forth in part in the description which follows, and in part are obvious from the description, or may be learned by practice of the disclosed embodiments. The aspects and advantages of the disclosed embodiments may also be realized and attained by the means of the instrumentalities and combinations particularly pointed out in the appended claims.

BRIEF DESCRIPTION OF THE DRAWINGS

The disclosed embodiments will hereinafter be described in conjunction with the appended drawings provided to illustrate and not to limit the disclosed embodiments, wherein like designations denote like elements, and in which.

DETAILED DESCRIPTION

Figure 1:
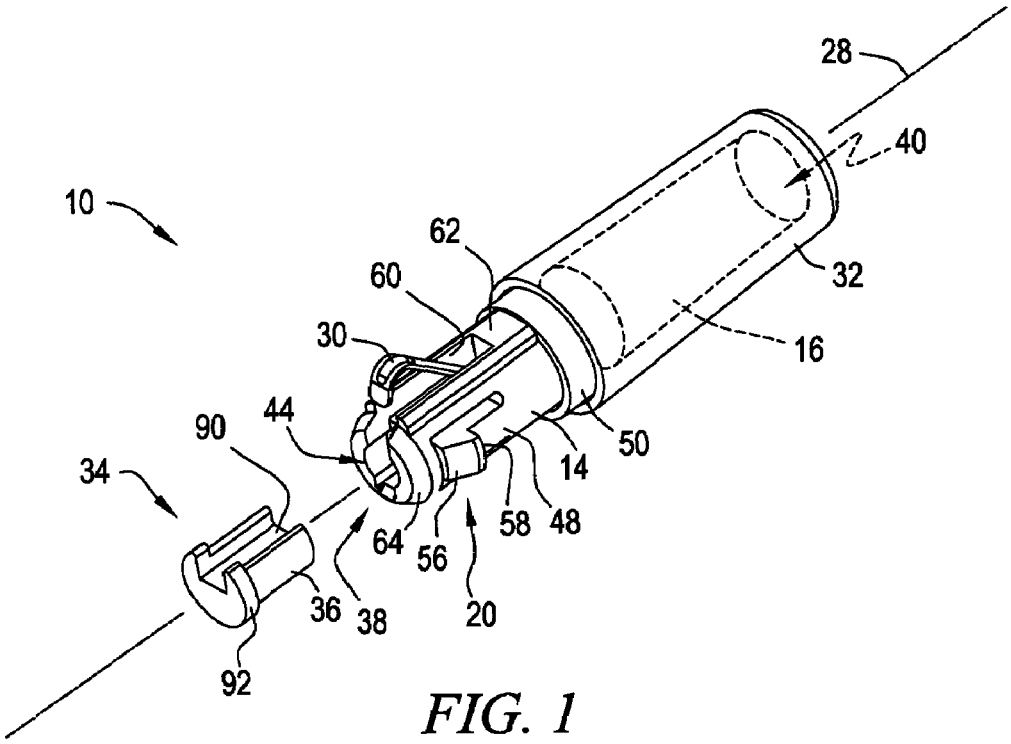
FIG. 1 is a front perspective view of one embodiment of an antenna assembly.
Figure 2:
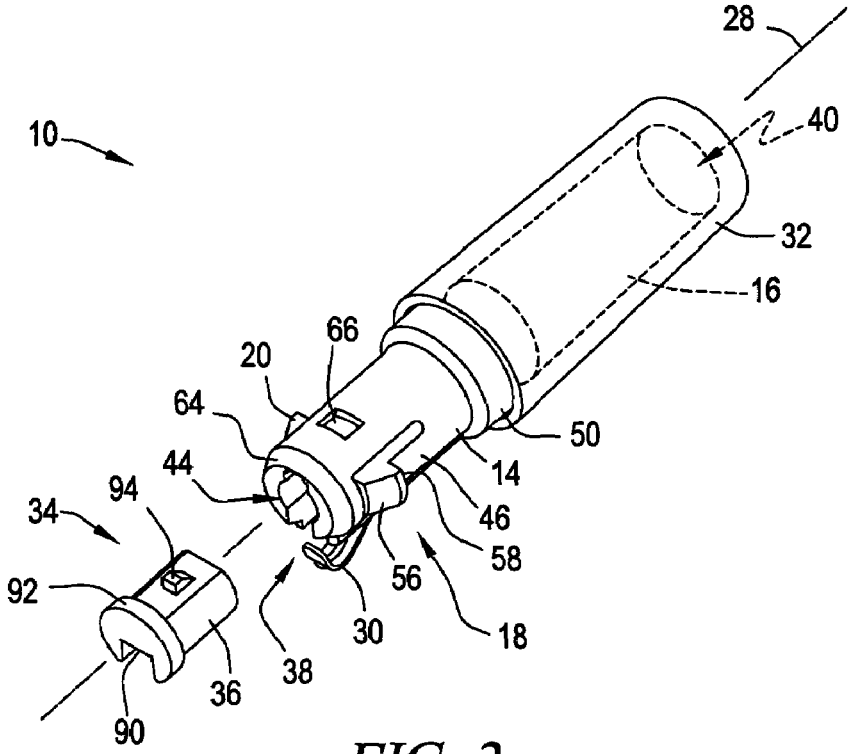
FIG. 2 is a back perspective view of the antenna assembly of FIG. 1.
Figure 3:
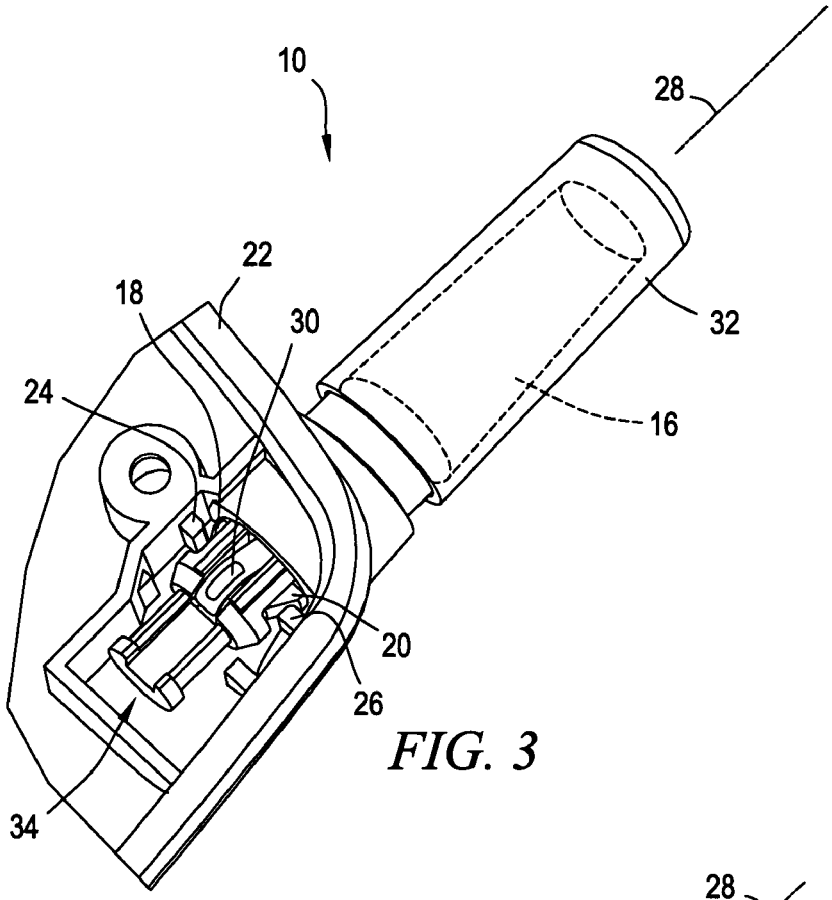
FIG. 3 is a front perspective view of the antenna assembly of FIG. 1, in an unlocked position, in the process of being secured within one embodiment of a rear housing of a communications device.
Figure 4:
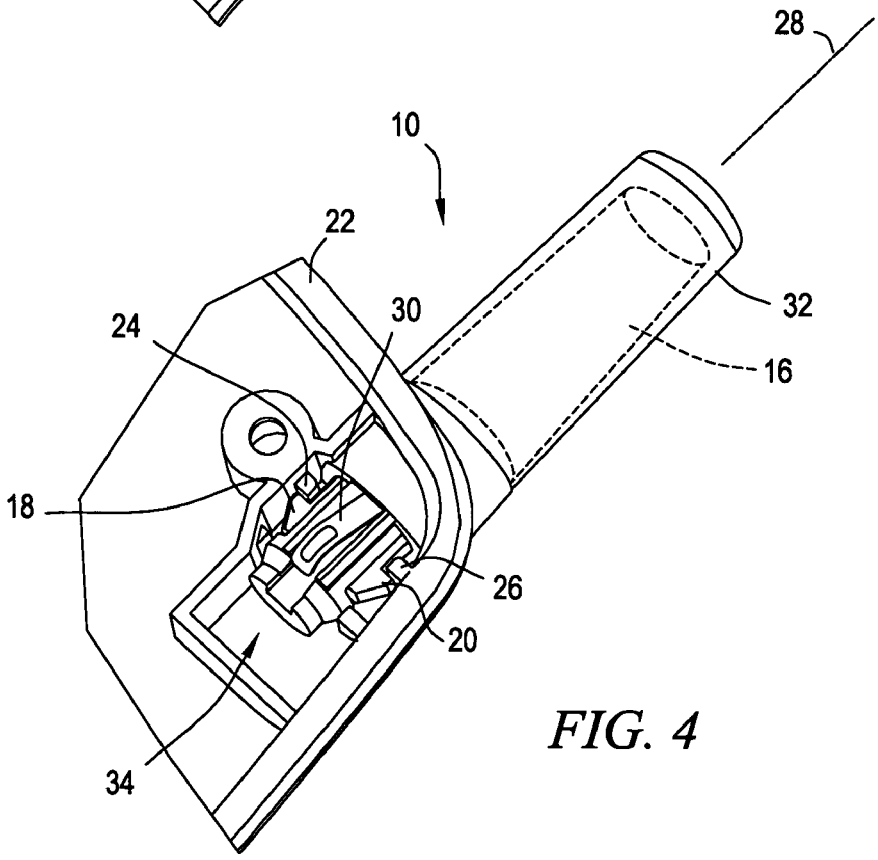
FIG. 4 is a front perspective view, similar to FIG. 3, of the antenna assembly of FIG. 1 in a fully secured or locked position with respect to one embodiment of a rear housing of a communications device.

The disclosed embodiments include devices and methods for retaining an antenna in a wireless communications device. The devices and methods include an irreversible retaining mechanism that locks the antenna into the device to prevent tampering and to withstand dropping. The irreversible aspect of the disclosed embodiments securely locks the antenna into the device such that once inserted, it cannot be removed without evidence of tampering. Thus, the present devices and methods result in a wireless communications device having a robust, durable and tamper-resistant antenna system.

Referring to FIGS. 1-4, one embodiment of an antenna assembly 10 for use with a communications device 12 (FIG. 5) includes a connector body 14 that holds an antenna element 16 for transmitting and/or receiving wireless signals. Connector body 14 includes one or more engagement members 18, 20 movable between an unlocked position and a locked position with respect to a housing 22 of communications device 12. In particular, engagement members 18, 20 are movable with respect to corresponding engagement members 24, 26 (FIG. 3) located on housing 22. In the unlocked position antenna assembly 10 is movable relative to communications device 12 in a direction substantially parallel to its longitudinal axis 28. In the locked position antenna assembly 10 is fixedly positioned with respect to communications device 12, at least with respect to movement in a direction substantially parallel to longitudinal axis 28. In one embodiment, for example, engagement members 18, 20 may be flexible detents and engagement members 24, 26 may be wall structures, such that upon insertion into housing 22 the detents deflect and then lock against the wall structures to hold antenna assembly 10 in place. Further, antenna assembly 10 includes an electrical conductor 30 that may be secured to connector body 14 such that a first contact end connects with antenna element 16 and a second contact end extends from the connector body 14 to enable contact with electronic circuitry of communications device 12. Antenna assembly 10 may further include a sheath 32 secured to connector body 14 and covering antenna element 16, protecting it from damage. Additionally, antenna assembly 10 may further include a retainer mechanism 34 having a retainer body 36 fixedly positionable relative to at least one of engagement members 18, 20 or 24, 26 to secure antenna assembly 10 in the locked position relative to communications device 12. In one embodiment, for example, retainer body 36 may be positioned to prevent flexing of a detent-style engagement member 18, 20 so as to maintain antenna assembly 10 in a locked position with respect to housing 22 of communications device 12. Thus, retainer mechanism 34 provides a one-way or irreversible locking mechanism to secure antenna assembly 10 to communications device 12.

Referring to FIGS. 1, 2, 6 and 7, connector body 14 includes one or more engagement members 18, 20 that include any mechanism for lockably securing antenna element 16 to communications device 12. As such, engagement members 18, 20 may include a surface or wall that projects from or extends into connector body 14. In one embodiment, for example, connector body 14 extends longitudinally from a first end 38 to a second end 40 along axis 28. First end 38 includes engagement members 18, 20 for securing connector body 14 to housing 22 of communications device 12. An internal wall 42 extends the longitudinal length of connector body 14 and defines at least one internal chamber 44 having openings at first end 38 and second end 40. Internal chamber 44 may include one or more sections or portions that may be sized differently. In this embodiment, engagement members 18, 20 are formed by U-shaped slots within wall 42 thereby defining detent mechanisms having legs 46, 48 flexibly connected to a base portion 50 of connector body 14 and extending longitudinally toward first end 38. Further, the distal end of each leg 46, 48 (FIGS. 1 and 2) includes a radially-extending projection 52, 54 that interacts with engagement members 24, 26 of housing 22 to lock antenna assembly 10 in place. For example, each projection 52, 54 may include a body having an angled surface 56 and a limiting surface 58. Angled surface 56 increases in height as it extends toward second end 40 and upon insertion of antenna assembly 10 into housing 22 interacts with engagement members 24, 26 to cause legs 46, 48 to flex. Limiting surface 58 forms a wall at any angle less than or equal to 90 degrees relative to longitudinal axis 28 so as to resist movement of antenna assembly 10 in the direction of longitudinal axis 28 when limiting surface 58 interacts with the corresponding portion of housing engagement members 24, 26. For example, at an angle of less than 90 degrees relative to axis 28, limiting surface 58 undercuts the body of projection 52, 54 defining a hook-like engagement surface that provides increased resistance to pull-out of antenna assembly 10, by preventing legs 46, 48 from flexing, when compared to a limiting surface that is substantially perpendicular to axis 28. Additionally, in one particular embodiment, two or more engagement members 18, 20 are utilized to provide increased fixation of antenna assembly 10 relative to housing 22. For example, attempts to remove antenna assembly 10 by wiggling or pulling may be substantially resisted by positioning two engagement members 18, 20 opposite from one another on connector body 14.

Additionally, first end 38 may include a slotted opening 60 that provides a clearance space for electrical conductor 30 to connect to communications device 12. Further, first end 38 may include a key 62 defined by a raised portion of connector body 14 that interacts with a corresponding keyed recess in housing 22. Key 62 is referenced with respect to slotted opening 60 so that antenna assembly 10 may only be installed into housing 22 in one orientation, thereby assuring a proper connection between electrical conductor 30 and the circuitry of communications device 12. As such, key 62 prevents rotation of antenna assembly 10 about axis 28 once it engages housing 22. Additionally, first end 38 may include an angled leading edge surface 64 to correct for misalignment between antenna assembly 10 and housing 22 upon insertion. Angled leading edge surface 64 creates a smaller leading end and transitions to the full height and width of the first end 38, thereby easing insertion of antenna assembly 10 into housing 22. Also, first end 38 may include a retainer engagement surface 66, such as a depression, projection or opening in wall 42 that cooperates with at least a portion of retainer mechanism 34 to fixedly position retainer mechanism 34 relative to connector body 14.

Connector body 14 also includes another internal wall 68 (FIG. 7) associated with base portion 50 that defines an intermediate chamber between first end 38 and second end 40. As such, base portion 50 provides a support for engagement members 18, 20 and for securing antenna element 16 within connector body 14. In particular, referring to FIG. 7, antenna element 16 may be mounted within internal chamber 44 at second end and secured in place via a bushing 70 that fits within second end 40 through internal chamber 44 and within the intermediate chamber against internal wall 68. In this embodiment, for example, antenna element 16 may comprise an elongated electrically conductive material having a predetermined diameter, and wound into a helix or coil having one or more predetermined diameters, one or more predetermined pitches, and a predetermined number of turns depending on the specific characteristics of the desired signals to be received or sent. It should be noted, however, that antenna element 16 may be any structure or any configuration capable of transmitting and/or receiving radio signals. Additionally, bushing 70 may secure a first contact end 72 of electrical conductor 30 within connector body 14 and maintain the first contact end in electrical continuity with antenna element 16. In this embodiment, for example, electrical conductor 30 includes any electrically conductive material, such as a metal or a semiconductor, capable of transferring electrical current between antenna element 16 and the circuitry associated with communications device 12. In particular, electrical conductor 30 may include first contact end 72 connected to second contact end 74 through a relatively narrow and thin longitudinally extending conductor body 76. Conductor body 76 may comprise a relatively resilient material that may be positioned at a predetermined angle 78 relative to longitudinal axis 28 such that second contact end 74 provides a biasing force normal to the longitudinal axis. Such biasing enables second contact end 74 to maintain a secure and continuous connection with the circuitry of communications device 12. Additionally, second contact end 74 may be curved or angled with respect to longitudinal axis 28 so that upon insertion into housing 22 it smoothly engages the circuitry of communications device 12 and creates the above-described biasing force.

Second end 40 of connector body 14 may further include one or more mating portions 80, 82 (FIGS. 6 and 7) for securing sheath 32 to connector body 14. Mating portions 80, 82 may include bodies projecting from connector body or walls extending into connector body, and may interact with one or more corresponding mating portions 84, 86 (FIG. 7) defined on internal wall 88 (FIG. 7) of sheath 32. Internal wall 88 of sheath 32 thereby defines an internal chamber having one open end through which sheath 32 receives second end 40 of connector body 14. Furthermore, sheath 32 may be a tubular, enveloping structure formed from a material that permits transmission of radio waves. Suitable materials for sheath 32 may include plastics, composites, etc.

Referring back to FIGS. 1 and 2, retainer mechanism 34, in one embodiment, is insertable at first end 38 of connector body 14 within a portion of internal chamber 44. Retainer body 36 thereby blocks the detent-style engagement members 18, 20 from deflecting inward and thus substantially prevents antenna assembly 10 from being removed from housing 22, such as by wiggling or pulling, after installation. Retainer body 36 may further include a recessed portion 90 to provide clearance for electrical conductor 30 to extend through internal chamber 44 and move normal to longitudinal axis 28. Additionally, retainer mechanism 34 may include a flange 92 for limiting the depth of insertion of retainer body 36 into first end 38. Furthermore, retainer mechanism 34 may also include engagement mechanism 94, such as a depression, projection or opening in retainer body 36 that corresponds to retainer engagement surface 66 (FIG. 2) in connector body 14. Engagement mechanism 94, in cooperation with retainer engagement surface 66, insures that retainer mechanism 34 maintains a substantially fixed position relative to connector body 14.

Referring back to FIGS. 3 and 4, antenna assembly 10 may be inserted into housing 22 such that engagement members 18, 20 of connector body 14 connect with engagement members 24, 26 of housing 22. Engagement members 24, 26 may include any structure that corresponds with engagement members 18, 20 to effectively lock antenna assembly 10 to housing 22. As such, this corresponding structure may include a surface or wall that extends from or protrudes into the wall of housing 22. In one embodiment, for example, engagement members 24, 26 are defined by flanges extending from the internal surface of housing 22. Upon insertion of connector body 14, these flanges 24, 26 are contacted by angled surfaces 56 (FIGS. 1, 2 and 6) of engagement members 18, 20 and thus force leg portions 46, 48 to bend inward toward axis 28 until limiting surfaces 58 (FIGS. 1, 2 and 6) pass through the flanges and allow leg portions 46, 48 to spring back. At this point, limiting surfaces 58 are engageable with the flanges of engagement members 24, 26 to limit or substantially prevent movement of antenna assembly along axis 28. Further, referring to FIG. 7, at this point, second contact end 74 of conductor 30 is engaged in a biased connection with the circuitry of communications device 12, such as against a conductive pad 75 on a circuit board 98. Thus, antenna assembly 10 is irreversibly connected to communications device 12.

Figure 5:
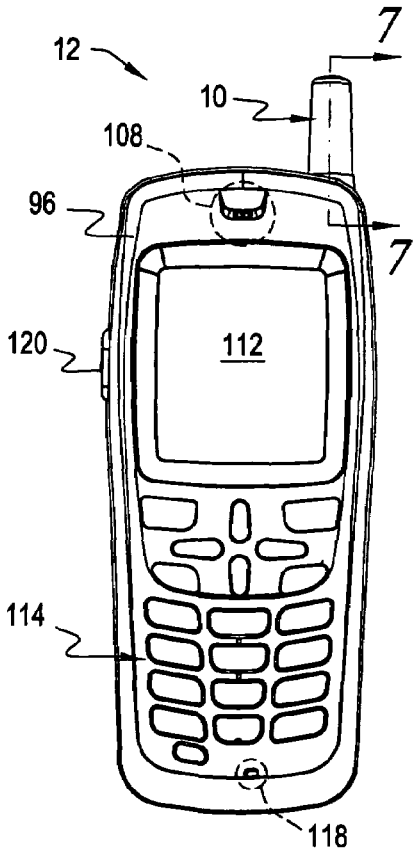
FIG. 5 is a front view of one embodiment of a communications device with the antenna assembly of FIG. 1.
Figure 6:
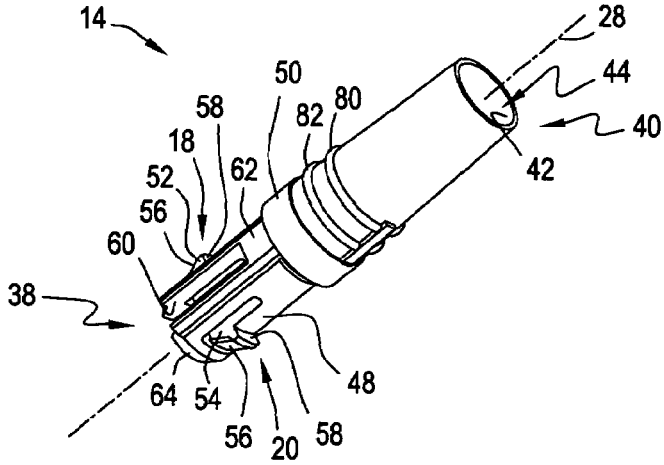
FIG. 6 is a front perspective view of a connector body of the antenna assembly of FIG. 1.
Figure 7:
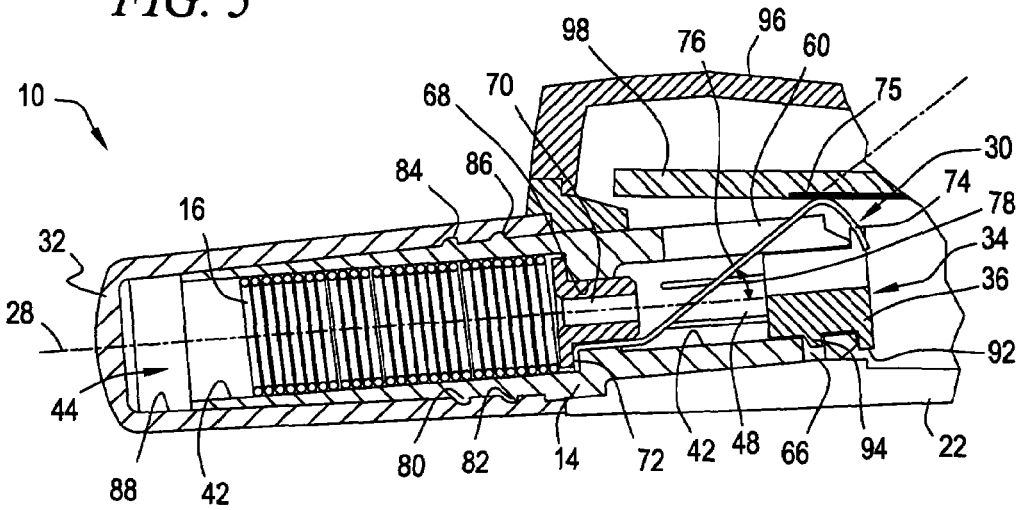
FIG. 7 a cross-sectional view along line 7-7 of FIG. 5 of the antenna assembly inserted within the rear housing.
Figure 8:
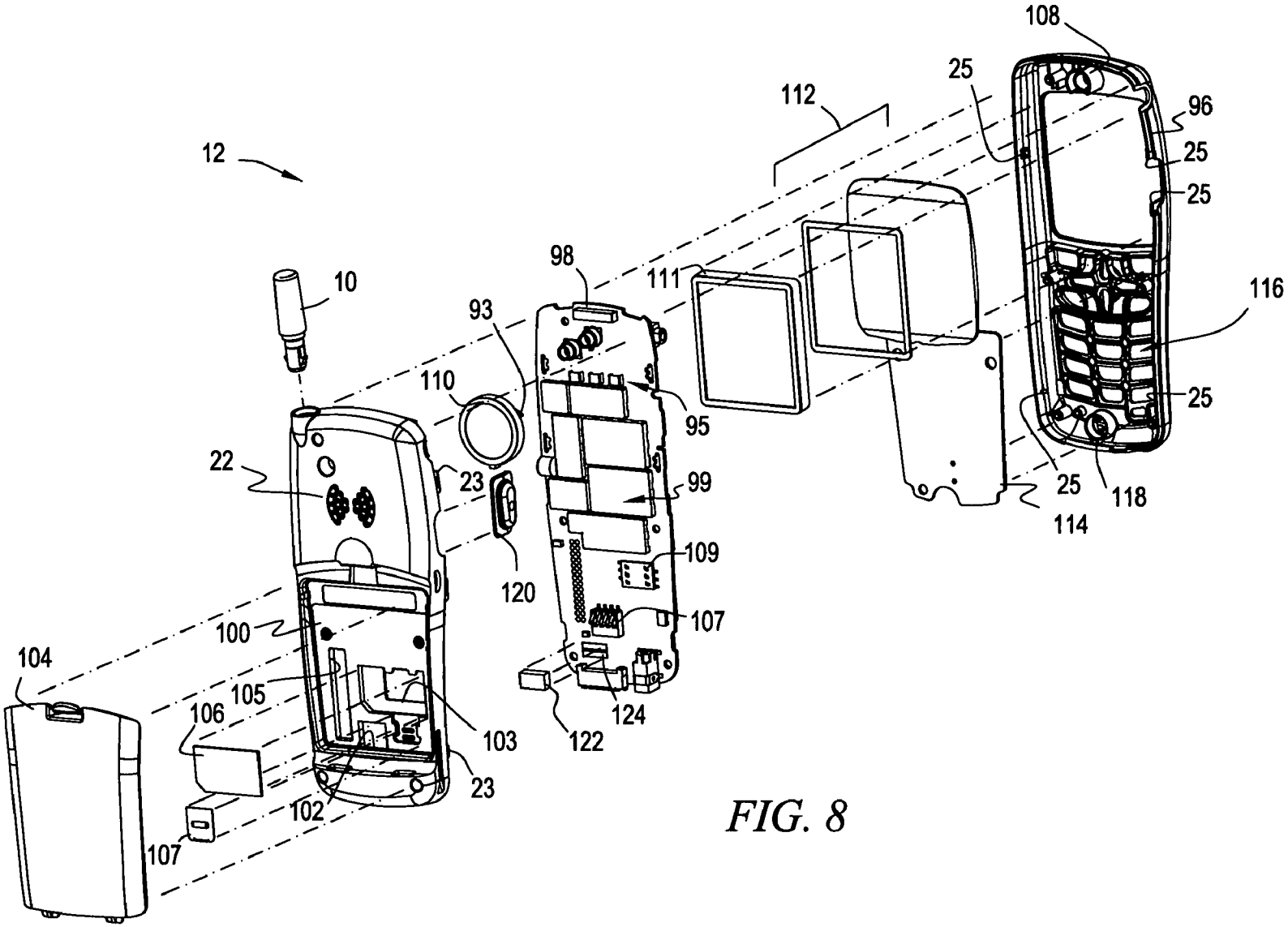
FIG. 8 is an exploded view of the remaining components of one embodiment of the communications device of FIG. 5, which includes the antenna assembly of FIG. 1.

Referring to FIGS. 5 and 8, communications device 12 may include any type of device for sending and/or receiving communications-related signals. Suitable examples of communications device 12 include a visual output or display device, an audio output device, a mobile phone such as a code division multiple access ("CDMA")-, wide-band code division multiple access ("WCDMA")-, global system for mobile communications ("GSM")-, advance mobile phone service ("AMPS")- and time division multiple access ("TDMA")-based system, a satellite phone, a portable phone, a pager, a wireless two way communications device, a personal digital assistant, a personal computer, a gaming system, a remote control system, a global positioning system ("GPS") receiver or controller, devices communicating via Bluetooth technology, and other similar types of communications systems involving the receipt and/or transmission of short- or long-range communications signals. For example, one embodiment of communications device 12 includes the Qualcomm QSec 2700 mobile phone. Communications device 12 may further include a front housing 96 that mates with housing 22, which is a rear housing. Housings 22, 96 may include corresponding engagement mechanisms 23, 25 to fix the housings together. Engagement mechanisms 23, 25 may be structured to lock housings 22, 96 together such that any attempted separation of the housings results in damage that provides evidence of tampering. Suitable examples of engagement mechanisms 23, 25 include at least one of snaps, detents, screws, nails, adhesives, etc. Either front housing 96 or rear housings 22 may provide one or more mounting surfaces for the remaining components of communications device 12. In one embodiment, for example, rear housing 22 includes an internal surface that supports communications module 98, such as a printed circuit board having predetermined communications components 99. Predetermined communications components 99 include various circuit elements that provide communications device 12 with a desired communications functionality. Suitable examples of predetermined communications components 99 include various printed circuit layouts, pathways of conductive traces, resistors, capacitors, inductors, transistors, chips, electromagnetic shields, contact pads or lands, and various connectors such as radio frequency ("RF") connectors, earpiece connectors, charger connectors, etc. Rear housing 22 further may include a recessed portion 100 having one or more openings 102, 103, 105. For instance, a power module 104, such as a battery pack, may be removably positioned in recessed portion 100 such that its electrical connectors mate through opening 102 with a corresponding electrical connector 107 on communications module 98. Further, a communications card 106, such as a removable user identity module ("RUIM"), may be removably positioned within recessed portion 100, such as with a retaining clip 107, such that its electrical connectors mate through an opening 103 with a corresponding electrical connector 109 on communications module 98. Additionally, communications device 12 may include input and/or output devices, such as near-field and far-field audio speakers 108, 110 and one or more visual display units 111, respectively connected to communications module 98. For instance, far-field audio speaker 110 may have leads 93 connected to communications module 98 via electromechanical standoffs 95, which may also support speaker 110 above communications module 98 to create additional space for mounting additional circuit elements. A lens assembly 112, which may include a transparent lens member and a gasket member, may be mounted over output device 111 to provide a protective, see-through covering. Lens assembly 112 may be sandwiched between front and rear housings 22 and 96 so as to resist movement so that any attempt to separate the lens from the front housing results in damage to the front housing and/or the lens, and thus provides evidence of tampering. Further, an input mechanism 114, such as a keypad and navigation mechanism and corresponding keys, may be located within housings 22, 96 and extend through predetermined openings 116 in front housing 96. An audio input mechanism 118, such as an microphone for transmitting a user's voice, may also be positioned between housings 22, 96. Further, in an embodiment of a phone, a push-to-talk button 120 may be extend from housings 22, 96 and connect to corresponding switches on communications module 98. Similarly, a vibrator motor 122 for silently signaling a user may be positioned within one of housings 22, 96 and engaged with a corresponding connector or contact pad 124 on module 98.

Further, additional details of the structure and assembly of the lens may be found in co-pending application Ser. No. 10/963,962, entitled "Devices And Methods For Retaining A Lens In A Mobile Electronic Device, " filed concurrently herewith and incorporated by reference above. Also, further details of the structure and assembly of the standoff mechanism may found in co-pending application . Ser. No. 10/964,105, entitled "Devices And Methods For Creating An Electrical Connection, " filed concurrently herewith an incorporated by reference above. And, more details of the structure and assembly of the mechanism connecting the housing may be found in co-pending Application Ser. No. 10/964,405, entitled "Devices And Methods For Connecting Housings, " filed concurrently herewith and incorporated by reference above.

While the various disclosed embodiments have been illustrated and described, it will be clear that the subject matter of this document is not limited to these embodiments only. For instance, in an alternate embodiment, housing engagement members may be defined by detent-like structures while connector body engagement members are wall-like projections or depressions. Further, in such an embodiment, rather than defining a collar-like structure, retainer mechanism may include a ring-like or clip-like structure that is insertable over the detent-like structures of the housing. Numerous modifications, changes, variations, substitutions and equivalents will be apparent to those skilled in the art without departing from the spirit and scope of the disclosed embodiments as described in the claims.

What is claimed is:

1. An electronic device, comprising:

a housing having a first mounting surface and at least one wall structure extending from the first mounting surface;

a communications interface connectable with electronic circuitry and positionable within the housing on the first mounting surface; and an antenna assembly for establishing a connection with a wireless communications media, the antenna assembly comprising:

an antenna mechanism connectable with the communications interface:

a connector body having an internal wall defining an internal chamber and at least one flexible engagement member configured to flex into the internal chamber during engagement of the antenna assembly with the housing, wherein the at least one flexible engagement member is configured to engage the at least one wall structure; and a retainer mechanism fixedly positionable within the internal chamber of the connector body to substantially prevent the at least one flexible engagement member from flexing and to substantially prevent removal of the antenna assembly from the housing.

2. The device of claim 1, wherein the at least one flexible engagement member comprises a longitudinally extending leg portion having a projection extending therefrom, wherein the leg portion is deflectable relative to the internal wall of the connector body.

3. The device of claim 2, wherein the projection comprises a first contact surface and a second contact surface, and wherein in a first state the first contact surface of the projection contacts the at least one wall structure and biases the leg portion to flex, and in a second state the second contact surface of the projection extends beyond the at least one wall structure such that a movement of the projection toward the at least one wall structure in a direction parallel to a longitudinal axis of the connector body causes the second contact surface to interfere with the at least one wall structure.

4. The device of claim 2, further comprising an electrical conductor having a first contact end connected to a second contact end through a longitudinally extending conductor body, wherein the connector body defines a longitudinal axis, and wherein at least a portion of the conductor body has a non-parallel position relative to the longitudinal axis.

5. The device of claim 1, wherein the at least one wall structure and the connector body have a first locked position and a second unlocked position, wherein in the first locked position the antenna assembly is connected to and prevented from moving apart from the housing, and in the second unlocked position the antenna assembly is movable apart from the housing, and wherein the retainer mechanism comprises a retainer body positionable between a first position and a second position corresponding to the first locked position and the second unlocked position, wherein in the first position the retainer body is positioned adjacent to the at least one wall structure and the connector body to maintain the first locked position.

6. The device of claim 5, wherein the retainer body and the connector body each further comprise corresponding fixedly securable engagement mechanisms.

7. The device of claim 5, wherein the retainer mechanism further includes a flange for limiting the relative position of the retainer body with respect to the connector body.

8. The device of claim 1, further comprising a sheath positionable over the antenna mechanism, and wherein at least one of the sheath and the connector body further comprises a mating portion fixedly securable with the other one of the sheath and the connector body.

9. The device of claim 1, further comprising an electronics assembly having a first output comprising a wireless communications signal.

10. The device of claim 9, further comprising a display device.

11. The device of claim 9, further comprising a user input device.

12. The device of claim 1, wherein the device is selected from the group consisting of a visual output or display device, an audio output device, a mobile phone, a satellite phone, a portable phone, a pager, a wireless two way communications device, a personal digital assistant, a personal computer, a gaming system, a remote control system, a global positioning system ("GPS") receiver or controller, devices communicating via Bluetooth technology, and communications systems involving the receipt and/or transmission of short- or long-range communications signals.

13. A wireless communications device, comprising:

a housing having at least one wall structure within the housing;

a communications module securable within the housing and having an antenna interface; and an antenna assembly, comprising:

a connector body longitudinally extending from a first end to a second end, the first end comprising at least one flexible engagement member configured to engage the at least one wall structure;

a retainer mechanism fixedly positionable within the connector body to substantially prevent the at least one flexible engagement member from flexing when the retainer mechanism is positioned within the connector body;

an antenna element securable relative to the connector body;

an electrical conductor having a first contact end and a second contact end, the first contact end connectable with the antenna element and the second contact end connectable with the antenna interface.

14. The device of claim 13, wherein the first end further comprises a first wall defining an internal chamber extending through at least a portion of the connector body and having an open end at the first end, wherein the retaining mechanism is positionable within the internal chamber to prevent relative movement of the at least one flexible engagement member into the internal chamber.

15. The device of claim 13, wherein the at least one wall structure and the at least one flexible engagement member is movable from a first position corresponding to an unlocked position of the antenna assembly relative to the housing and a second position corresponding to a locked position of the antenna assembly relative to the housing, wherein the retaining mechanism comprises a first surface fixedly positioned to prevent movement of the at least one wall structure and the at least one flexible engagement member into the first position.

16. The device of claim 14, wherein the retainer mechanism further comprises an engagement mechanism configured to maintain the retainer mechanism in a substantially fixed position relative to the connector body.

17. An antenna assembly for use with a communications device, comprising:

a connector having a connector body extending from a first end to a second end and thereby defining a longitudinal axis, the first end having a first flexible engagement member movable from an unlocked position to a locked position, wherein in the unlocked position the antenna assembly is movable along the longitudinal axis relative to the communications device and in the locked position the antenna assembly is not movable along the longitudinal axis relative to the communications device;

an antenna element securable relative to the connector body;

an electrical conductor having a conductor body with a first contact end and a second contact end, the first contact end connectable with the antenna element; and a retainer mechanism having a retainer body fixedly positionable relative to the first flexible engagement member to secure the antenna assembly in the locked position, wherein the retainer mechanism substantially prevents the first flexible engagement member from flexing and moving into the unlocked position.

18. The antenna assembly of claim 17, further comprising a second flexible engagement member positioned opposite the first engagement member and movable between the unlocked position and the locked position.

19. The antenna assembly of claim 18, wherein each of the first flexible engagement member and the second flexible engagement member comprises a first contact surface and a second contact surface, wherein in the unlocked position the first contact surface is translatable relative to the longitudinal axis and in the locked position the second contact surface is non-translatable relative to the longitudinal axis.

20. The antenna assembly of claim 17, wherein the retainer mechanism further comprises an engagement mechanism configured to maintain the retainer mechanism in a substantially fixed position relative to the connector body.

21. A method of attaching an antenna to a communications device, comprising:

providing a housing for the communications device, where the housing includes a first mounting surface and a first wall structure extending from the first mounting surface;

providing an antenna assembly for establishing a connection with a wireless communications media, the antenna assembly comprising an antenna element for sending or receiving communications signals and a connector body having a first flexible engagement member having a first contact position in which a first contact surface is translatable relative to the first wall structure and a second contact position in which a second contact surface is non-translatable relative to the first wall structure; and installing a retainer mechanism within the connector body, wherein the retainer mechanism substantially prevents the first flexible engagement member from flexing and moving out of the second contact position.

22. The method of claim 21, where the housing further comprises a second wall structure extending from the first mounting surface and the connector body further comprises a second flexible engagement member corresponding to the second wall structure positioned opposite to the first wall structure and the first flexible engagement member, respectively, where the second flexible engagement member includes a third contact position in which a third contact surface is translatable relive to the second wall structure and a fourth contact position in which a fourth contact surface is non-translatable relative to the second wall structure, and where the fourth contact position corresponds to the second contact position.

23. The method of claim 22, where at least one of the first flexible engagement member and the second flexible engagement member comprise a longitudinally extending leg portion having a projection extending therefrom, wherein the leg portion is deflectable relative to the corresponding one of the first wall structure and the second wall structure.

24. The method of claim 21, wherein the retainer mechanism comprises an engagement mechanism configured to maintain the retainer mechanism in a substantially fixed position relative to the connector body.

25. An electronic device, comprising:

a housing having a first mounting surface and at least one wall structure extending from the first mounting surface;

a communications interface connectable with electronic circuitry and positionable within the housing on the first mounting surface; and an antenna assembly for establishing a connection with a wireless communications media, the antenna assembly comprising:

means for connecting the antenna assembly to the communications interface;

means for defining an internal chamber;

means for flexing into the internal chamber during engagement of the antenna assembly with the housing;

means for engaging the at least one wall structure;

means for preventing the flexing means from flexing; and means for preventing removal of the antenna assembly from the housing.

26. The device of claim 25, further comprising:

means for locking the antenna assembly within the housing, wherein the means for locking the antenna assembly within the housing is movable between a first locked position and a second unlocked position, wherein in the first locked position the antenna assembly is connected to and prevented from moving apart from the housing, and in the second unlocked position the antenna assembly is movable apart from the housing.

27. The device of claim 26, further comprising:

means for retaining the antenna assembly in the first locked position, wherein the means for retaining the antenna assembly in the first locked position is positionable between a first position and a second position corresponding to the first locked position and the second unlocked position, wherein in the first position the means for retaining the antenna assembly in the first locked position is positioned adjacent to the at least one wall structure to maintain the first locked position.

28. The device of claim 27, further comprising:

means for fixedly securing the means for connecting the antenna assembly to the communications interface to the means for retaining the assembly in the first locked position.

29. The device of claim 28, further comprising:

means for limiting the relative position of the means for retaining the antenna assembly in the first locked position with respect to the means for connecting the antenna assembly to the communications interface.

30. The device of claim 25, further comprising:

means for covering the antenna assembly; and means for preventing damage to the antenna assembly.

31. The device of claim 30, further comprising:

means for fixedly securing the means for covering the antenna assembly to the antenna assembly.

32. The device of claim 25, further comprising:

means for providing at least one wireless communications signal.

33. The device of claim 32, further comprising:

means for displaying.

34. The device of claim 33, further comprising:

means for receiving user input.

* * * * *

UNITED STATES PATENT AND TRADEMARK OFFICE

CERTIFICATE OF CORRECTION

PATENT NO. : 7,486,240 B2
APPLICATION NO. : 10/964403
DATED : February 3, 2009
INVENTOR(S) : Chintala It is certified that error appears in the above-identified patent and that said Letters Patent is hereby corrected as shown below:

Column 8, line 45, claim 1: “interface:” to read as --interface;--

Column 10, line 2, claim 13: “body;” to read as --body; and--

Column 11, line 1, claim 21: “device, where” to read as --device, wherein--

Column 11, line 17, claim 22: “where the” to read as --wherein the--

Column 11, line 23, claim 22: “where the” to read as --wherein the--

Column 11, line 25, claim 22: “translatable relive” to read as --translatable relative--

Column 11, line 28, claim 22: “where the” to read as --wherein the--

Column 11, line 30, claim 23: “where at least” to read as --wherein at least--

Signed and Sealed this
Fifteenth Day of November, 2011

David J. Kappos

David J. Kappos
*Director of the United States Patent and Trademark Office*